United States Patent [19]

Linton et al.

[11] 4,389,944

[45] Jun. 28, 1983

[54] CONVEYOR CONTROL MEANS

[75] Inventors: Leon Linton; David B. Kiss, both of Memphis, Tenn.

[73] Assignee: Southern Systems, Inc., Memphis, Tenn.

[21] Appl. No.: 249,221

[22] Filed: Mar. 30, 1981

[51] Int. Cl.[3] ..... B61B 10/02

[52] U.S. Cl. ..... 104/172 S; 104/91

[58] Field of Search ..... 104/91, 96, 172 B, 172 BT, 104/172 S, 176

[56] References Cited

U.S. PATENT DOCUMENTS

| | | | |
|---|---|---|---|
| 3,559,586 | 2/1971 | Follrath | 104/172 S |
| 3,874,304 | 4/1975 | Robert | 104/172 S |
| 3,910,199 | 10/1975 | Ord | 104/172 S |

*Primary Examiner*—Randolph Reese
*Assistant Examiner*—David F. Hubbuch
*Attorney, Agent, or Firm*—Walker & McKenzie

[57] ABSTRACT

A mechanism for use with a power-and-free type conveyor to allow a trolley system to be pushed across a transfer zone or the like. The trolley system is composed of at least a leading trolley and a trailing trolley, and perhaps an intermediate trolley. The leading trolley is pushed across the transfer zone by virtue of the mechanism of the trailing, or intermediate, trolley. The mechanism includes a dog member attached to the trailing (or intermediate) trolley, a first drive member for moving the dog member to a first position in which it will be engaged by a pusher member and pushed across a transfer zone, and a second drive member for moving the dog member to a second position out-of-engagement with the pusher member. The mechanism is constructed so that the dog member will stay in either of the first or second positions until it is positively moved to the other position by either the first or second drive member.

5 Claims, 15 Drawing Figures

CONVEYOR CONTROL MEANS

BACKGROUND OF THE INVENTION

1. Field of the Invention

The present invention relates to an improvement in the control means of a power-and-free type conveyor and the like.

2. Description of the Prior Art

Linton, U.S. Pat. No. 3,889,606 and Curry et al, U.S. Pat. No. 3,451,352 disclose power-and-free conveyor systems that relate in general to the present invention. The '606 patent discloses a control means for a power-and-free conveyor system which includes a cam means for being fixedly attached to the support track of the conveyor system and a dog means for being attached to a load carrying trolley of the conveyor system. The cam means raises and holds the dog means in a position in which a pusher of a power track of the conveyor system will engage the dog means and push the trolley through a transfer station or the like. The dog means falls due to the force of gravity to a position out of engagement with the pusher as soon as it is no longer held up by the cam means. The '352 patent discloses a control means in which the cam means pivots the dog means to an up position and in which the dog means also is held in the up position only as long as it is in engagement with the cam means. Neither of the above patents disclose or suggest the present invention.

SUMMARY OF THE INVENTION

The present invention is directed towards improving upon prior conveyor control means. The control means of the present invention includes, in general, a dog means attached to a trolley member of a conveyor system for movement between a first position in engagement with a pusher member of the conveyor system and a second position out of engagement with the pusher member; a first means for moving the dog means from the second position to the first position; and a second means for moving the dog means from the first position to the second position, the dog means staying in either of the first or second positions until moved to the other of the first or second positions by the first or second means.

DESCRIPTION OF THE PREFERRED EMBODIMENT

Figure 1:
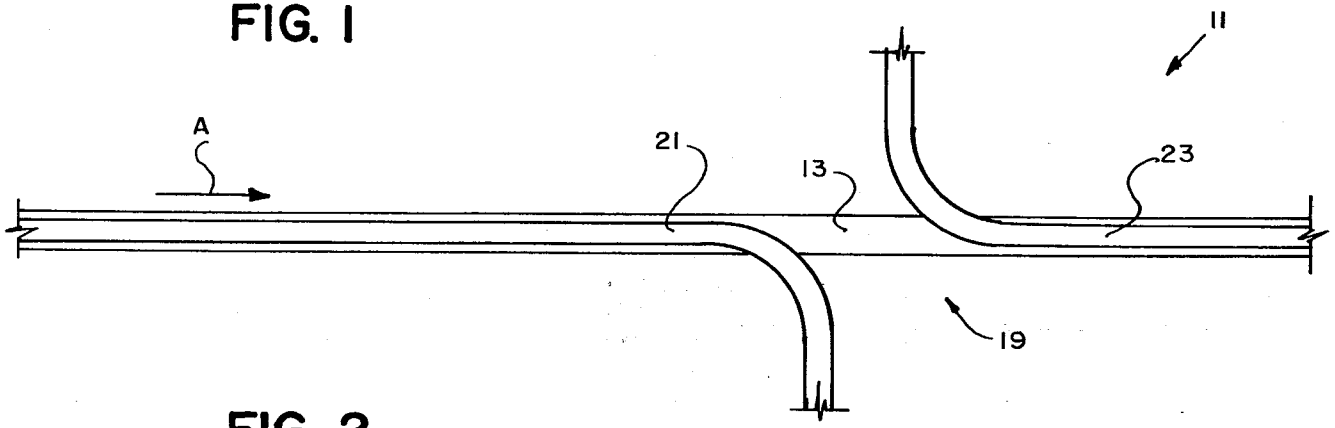
FIG. 1 is a somewhat schematic plan view of a portion of a power-and-free conveyor system including a transfer zone between a forwarding power track and a receiving power track.
Figure 2:
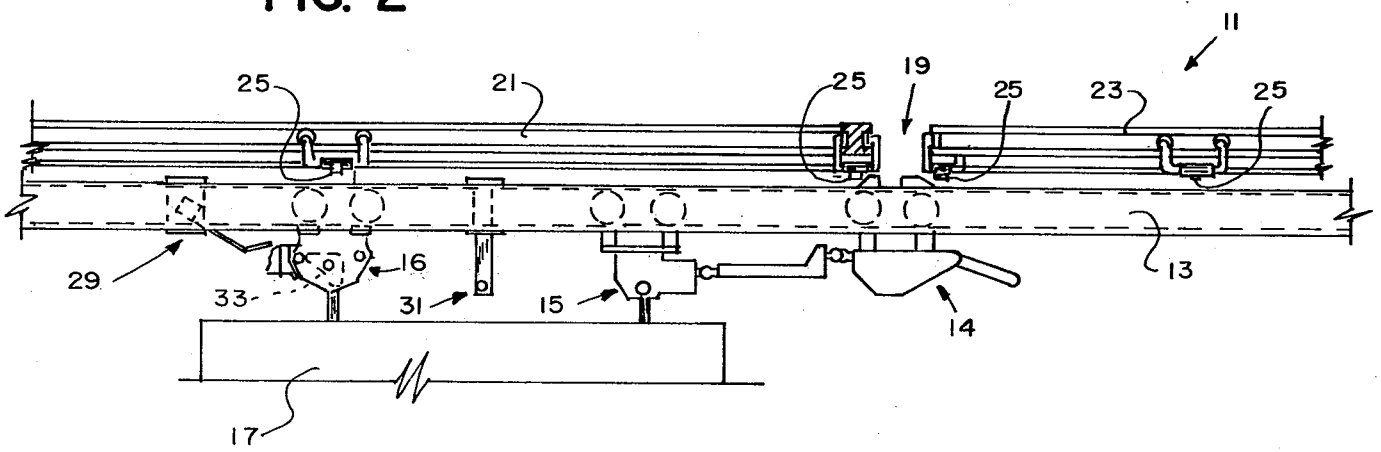
FIG. 2 is a side elevational view of the conveyor system shown in FIG. 1 including a trolley means and the control means of the present invention.

The control means of the present invention is for use with a typical power-and-free conveyor system 11 or the like (see FIGS. 1 and 2). The conveyor system 11 includes, in general, a load supporting track means 13, a trolley means for being movably mounted to the load supporting track means 13 and for supporting a load 17 to be conveyed from one location to another, and a power track means for causing the trolley means to move along the load supporting track means 13 in the direction of the arrow A in FIG. 1. The trolley means preferably includes a leading trolley 14 and a trailing trolley 16. An intermediate trolley 15 may also be included but is not absolutely necessary. The conveyor system 11 preferably includes a transfer zone 19 defined by a first or forwarding power track means 21 and a second or receiving power track means 23. Each power track means 21, 23 includes one or more pusher means 25 for selectively engaging a portion of the trolley means to move the trolley means along the load supporting track means 13. As evidenced by the above cited prior art, such conveyor systems are well-known to those skilled in the art and need not be discussed in detail to sufficiently disclose the present invention. The above cited Linton, U.S. Pat. No. 3,889,606 should be consulted for a more detailed description of the general operation and construction of such power-and-free conveyor systems.

Figure 3:
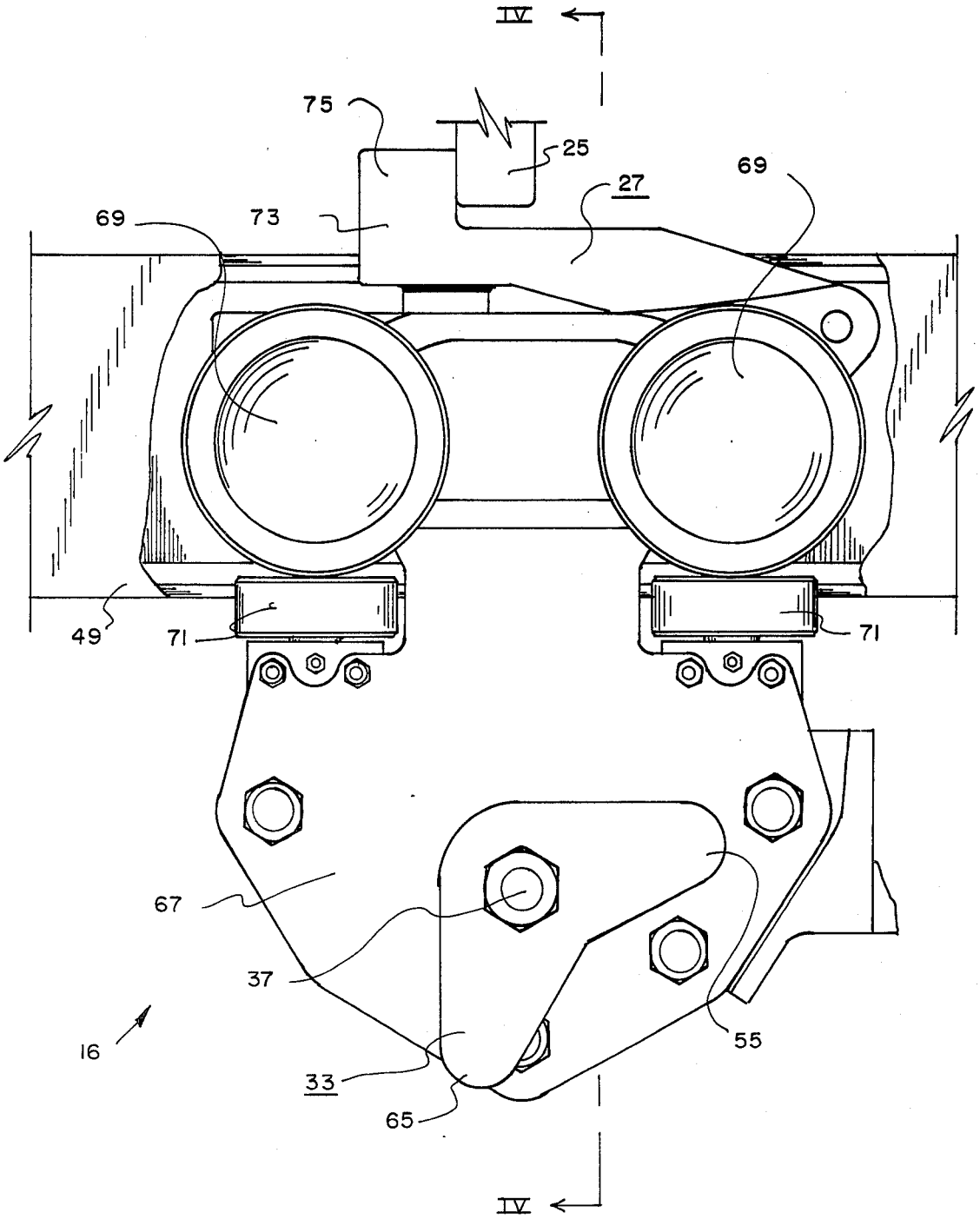
FIG. 3 is an enlarged side elevational view of a portion of the conveyor system shown in FIGS. 1 and 2 with portions thereof broken away for clarity.
Figure 15:
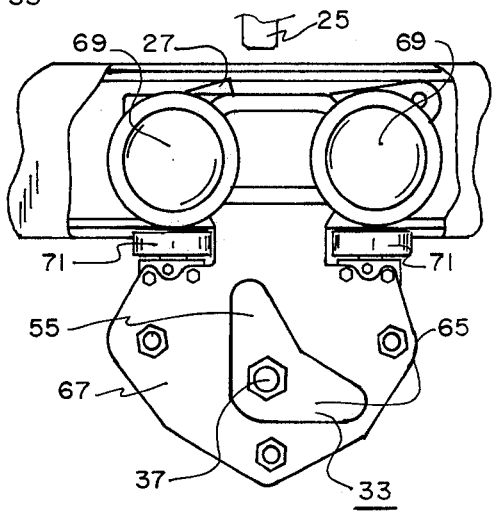
FIG. 15 is a side elevational view similar to FIG. 3 but with portions thereof in a moved position.

The control means of the present invention is preferably associated with the trailing trolley 16 and includes, in general, a dog means 27 for being attached to the trolley 16 and for movement between a first position in engagement with one of the pusher means 25 (see, in general, FIG. 3) and a second position out of engagement with the pusher means 25 (see, in general, FIG. 15); a first drive means 29 for being fixedly attached relative to the load supporting track means 13 and for moving the dog means 27 from the second position to the first position; and a second drive means 31 for being fixedly attached relative to the load supporting track means 13 and for moving the dog means from the first position to the second position, the dog means staying in either of the first or second positions until moved to the other of the first or second positions by the first or second drive means 29, 31.

Figure 8:
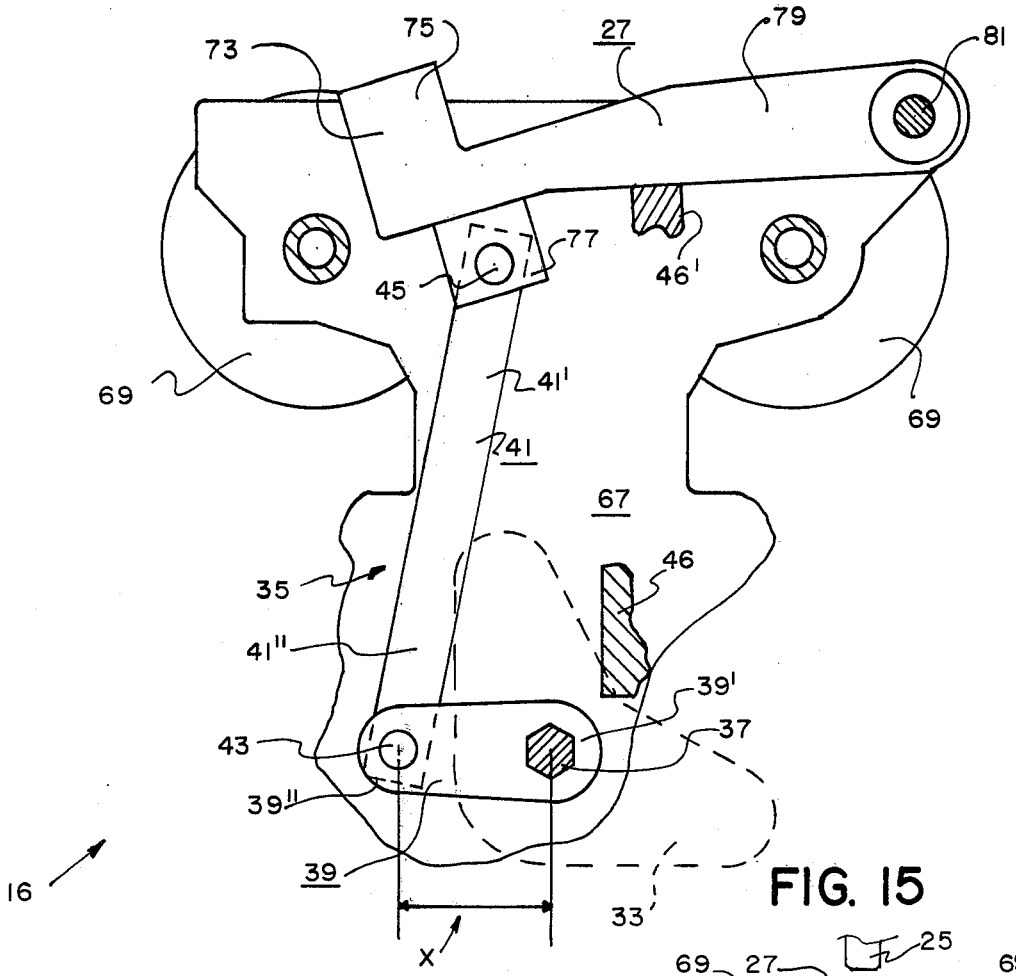
FIG. 8 is a somewhat schematic sectional view similar to FIG. 5 but with portions thereof in a moved position and with portions shown in broken lines for clarity.

The control means preferably includes a drivable means 33 attached to the trolley 16 for being moved between first and second positions by the first and second drive members 29, 31; and includes linkage means 35 extending between the drivable means 33 and the dog means 27 for causing the dog means 27 to move to the first position when the drivable means 33 is moved to the first position and to move to the second position when the drivable means 33 is moved to the second position. The drivable means 33 is preferably pivotally attached to the trolley 16 by way of a pivot means 37. More specifically, the drivable means 33 is preferably fixedly attached to the pivot means 37 causing the pivot means 37 to rotate when the drivable means 33 is moved between the first and second positions. The pivot means 37 is pivotally mounted on the trolley 16. The linkage means 35 preferably includes a first link member 39 having a first end 39' and a second end 39", and a second link member 41 having a first end 41' and a second end 41", and a pivot member 43 for pivotally attaching the second end 39", 41" of the first and second link members 39, 41 to one another (see, in general, FIGS. 5 and 8). The first end 39' of the first link member 39 is preferably attached to the drivable means 33 for pivotal movement therewith. More specifically, the first end 39' of the first link member 39 is preferably fixedly attached to the pivot means 37 for rotation therewith when the pivot means 37 is rotated by the drivable means 33. For example, the portion of the pivot means 37 that extends through the first end 39' of the first link member 39 may be substantially hexagonal in cross section and the aperture in the first end 39' for receiving the pivot means 37 may be correspondingly shaped (see, for example, FIGS. 5 and 8) so that rotation of the pivot means 37 will cause the first link member 39 to rotate as will now be apparent to persons skilled in the art. The first end 41' of the second link member 41 is preferably pivotally attached to the dog member 27 by way of a pivot member 45 or the like. The linkage means 35 is arranged so that the axis of the pivot member 43 is horizontally offset from the axis of the pivot means 37 when the dog means 27 is in either of the first or second position whereby the dog means 27 is caused to remain in either of the first or second positions until moved to the other of the first or second positions by the first or second drive means 29, 31 acting through the drivable means 33 and the linkage means 35 due to the "over center" positioning of the pivot member 43 when the dog means 27 is in either of the first or second positions as will now be apparent to those skilled in the art. This horizontal offset is clearly shown in FIG. 5 with the dog means 27 in the first position and in FIG. 8 with the dog means 27 in the second position and is identified by the letter "X". The body of the trolley 16 may include a stop member 46 (e.g., a wall) for limiting movement of the first link member 39 and, therefore, the dog means 27 in the first position (see FIG. 5). The body of the trolley may also include a stop member 46' (e.g., a rib) for limiting movement of the dog means 27 in the second position (see FIG. 8).

Figure 13:
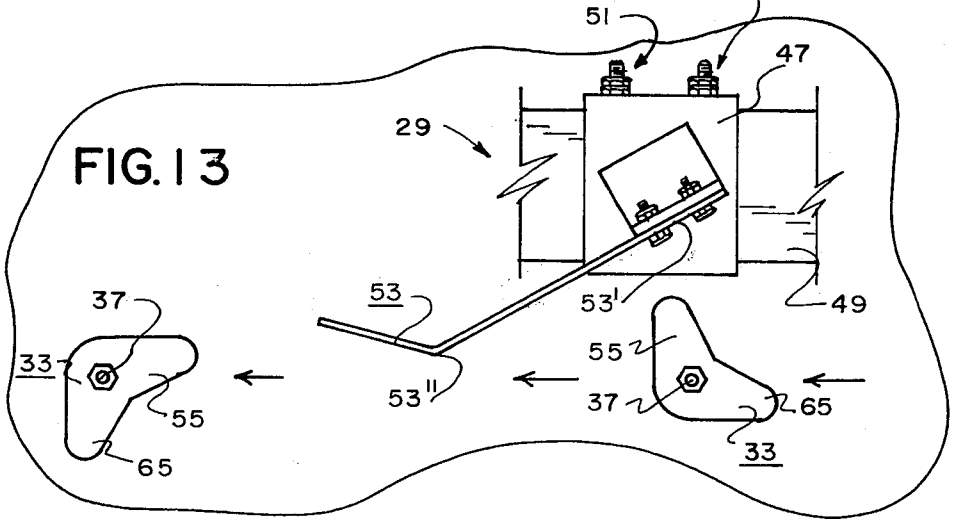
FIG. 13 is a side elevational view of FIG. 12.
Figure 14:
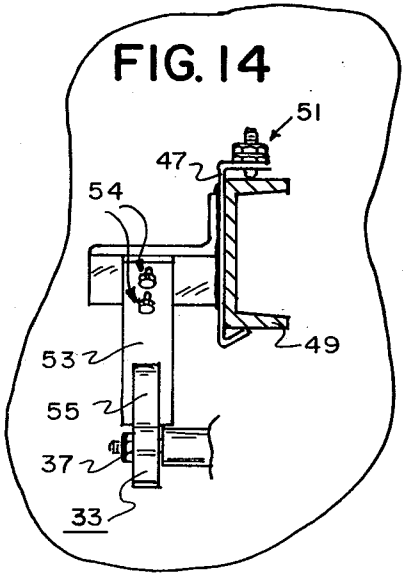
FIG. 14 is an end elevational view of FIG. 12.

The first drive means 29 preferably engages the drivable means 33 at a point above the axis of the pivot means 37 (see, in general, FIGS. 13 and 14). The second drive means 31 preferably engages the drivable means 33 at a point below the axis of the pivot means 37 (see, in general, FIGS. 10 and 11).

Figure 12:
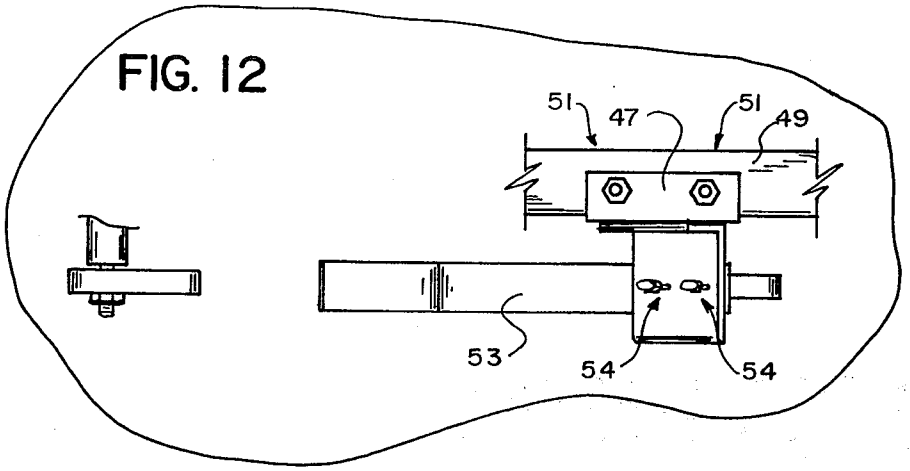
FIG. 12 is a somewhat diagrammatic top plan view of another portion of the control means of the present invention.

The first drive means 29 preferably includes a body member 47 for being fixedly attached to the load supporting track means 13 (see, in general, FIGS. 12, 13 and 14). For example, the load supporting means 13 may include a pair of opposed, inwardly directed channel members 49 and the body member 47 may be fixedly attached to one of the channel members 49 in any manner apparent to those skilled in the art. Preferably, the body member 47 is adjustably attached to one of the channel members 49 by way of a pair of screw assemblies 51 in a manner as will now be apparent to those skilled in the art from a review of the drawings. The first drive means 29 also preferably includes a spring member 53 having a first end 53' for being attached to the body member 47 in any manner apparent to those skilled in the art and having a second end portion 53" for contacting the drivable means 33 to cause the driveable means 33 to move from the first position to the second position. The spring member 53 is preferably adjustably attached to the body member 47 to allow "fine tuning" of the second end portion 53" relative to the drivable means 33. This adjustable attachment may be of any type known to those skilled in the art such as the bolt-and-slot arrangement 54 shown in FIG. 12. The second end portion 53" of the spring member 53 is constructed so that when the trolley means 16 moves down the load supporting track means past the first drive means 29 with the drivable means 33 in the second position, the second end portion 53" will contact a first ear portion 55 of the drivable means 33 and cause the drivable means 33 to pivot about the pivot means 37 to the first position as diagrammatically illustrated in FIGS. 12 and 13 whereby the dog means 27 will likewise move from the second position to the first position. Due to the inherent "spring" quality of the spring member 53, it also prevents jamming of the mechanism if a pusher means 25 happens to be substantially directly above the dog means 27 when the spring member 53 contacts the drivable means 33 thus preventing the dog means 27 from being moved to the first position. In such a case, the spring member 53 will merely "spring over" the drivable means 33 as will now be apparent to those skilled in the art.

Figure 11:
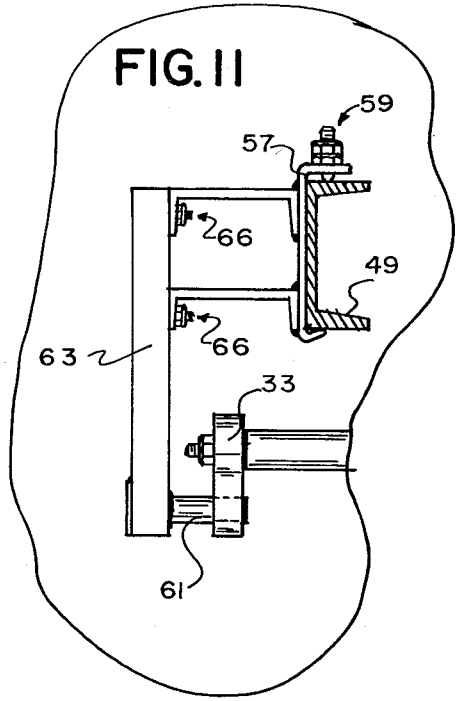
FIG. 11 is an end elevational view of FIG. 9.
Figure 9:
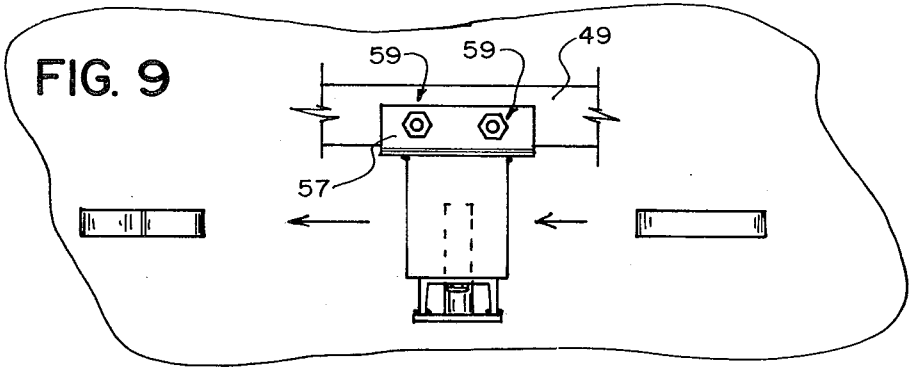
FIG. 9 is a somewhat diagrammatic top plan view of a portion of the control means of the present invention.
Figure 10:
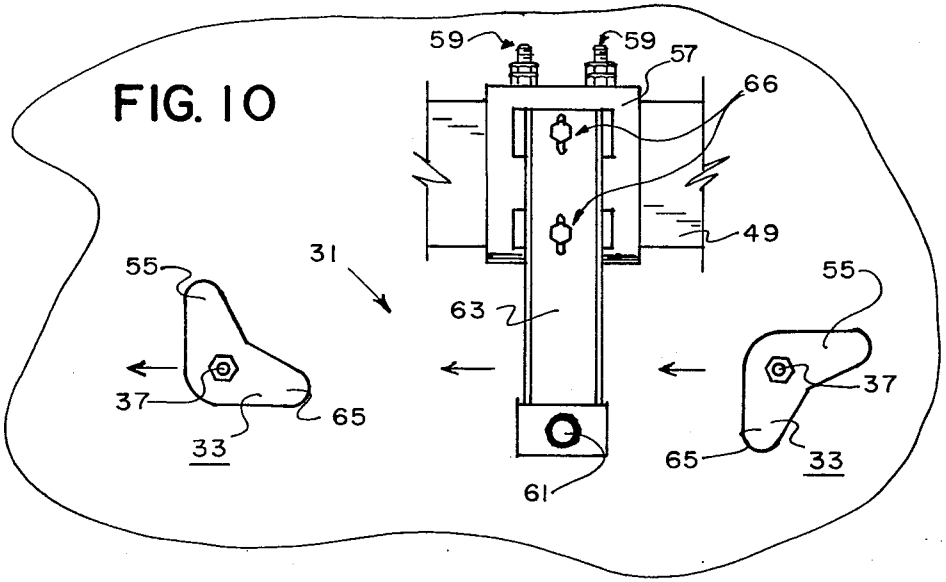
FIG. 10 is a side elevational view of FIG. 9.

The second drive means 31 also preferably includes a body member 57 for being fixedly attached to one of the channel members 49 (see, in general, FIGS. 9, 10 and 11). The body member 57 may be substantially identical to the body member 47. A pair of screw assemblies 59 substantially identical to the screw assemblies 51 may be provided for movably attaching the body member 57 to one of the channel members 49 in various fixed positions thereon. The second drive means 31 includes a pin member 61 fixedly attached to the body member 57 by way of an arm structure 63 or the like. The pin member 61 is positioned so that it will contact a second ear portion 65 of the drivable means 33 when the drivable means 33 is in the first position and when the trolley means 16 is moved past the second drive means 31 as diagrammatically illustrated in FIGS. 9 and 10. The pin member 61 contacts the drivable means 33 at a position below the axis of the pivot means 37 to cause the drivable means 33 to pivot from the first position to the second position thereby causing the dog means 27 to move from the first position to the second position. The pin member 61 is preferably adjustably attached to the body member 57 to allow "fine tuning" of the pin member 61 relative to the drivable means 33. This adjustable attachment may be of any type or construction known to those skilled in the art such as the bolt-and-slot arrangement 66 between the arm structure 63 and the body member 57 as clearly shown in FIG. 10.

Figure 4:
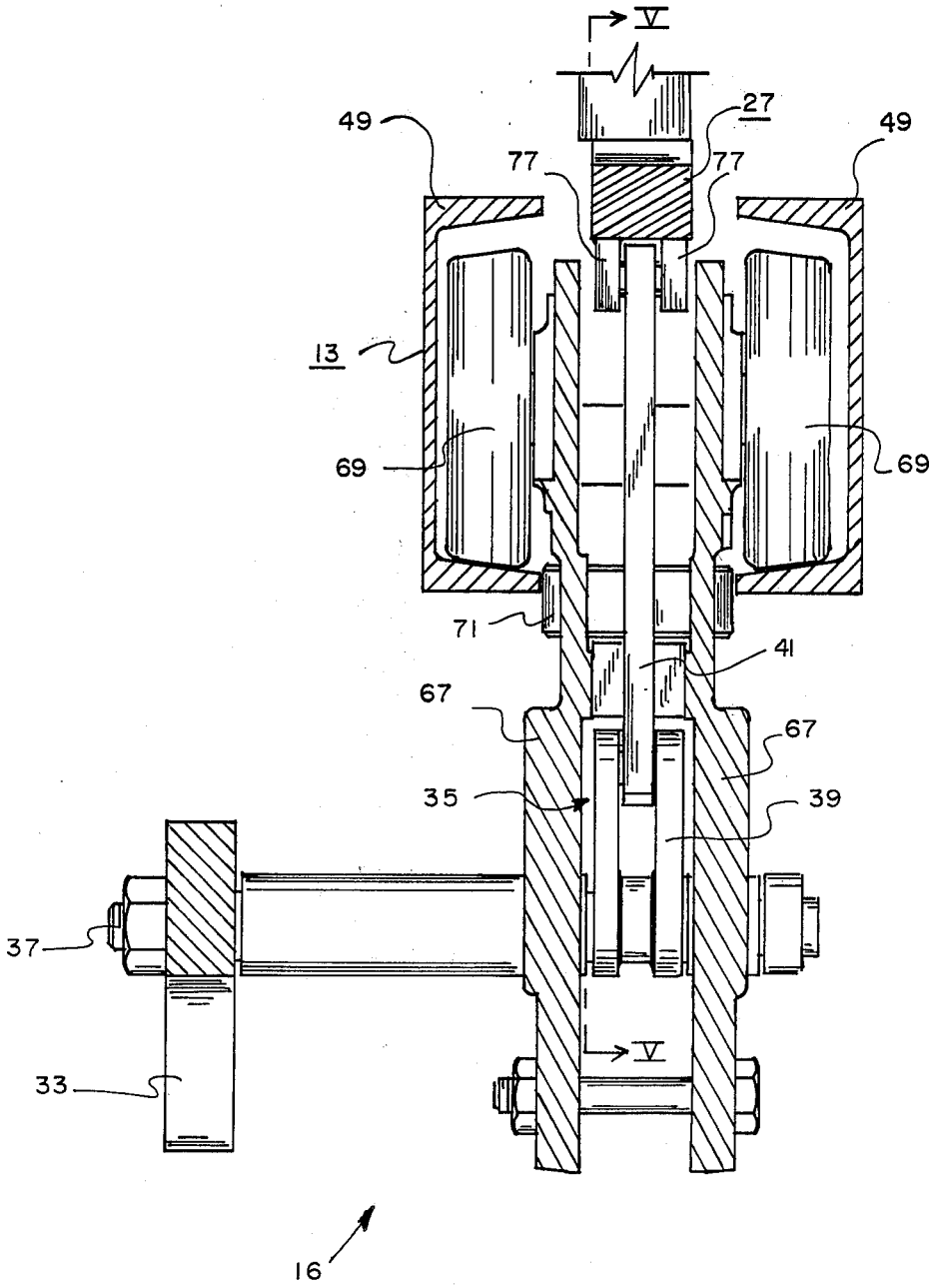
FIG. 4 is a sectional view as taken on line IV—IV of FIG. 3.

The trolley 16 preferably includes a hollow body member 67 (see, in general, FIG. 4) having a plurality of rollers 69 mounted thereon for engaging the channel members 49 to support the trolley means 16 from the load supporting track means 13 and having a plurality of rollers 71 mounted thereon for engaging the channel members 49 to act as guides to maintain the trolley means 16 substantially centered between the channel members 49 in a manner as will now be apparent to those skilled in the art.

Figure 5:
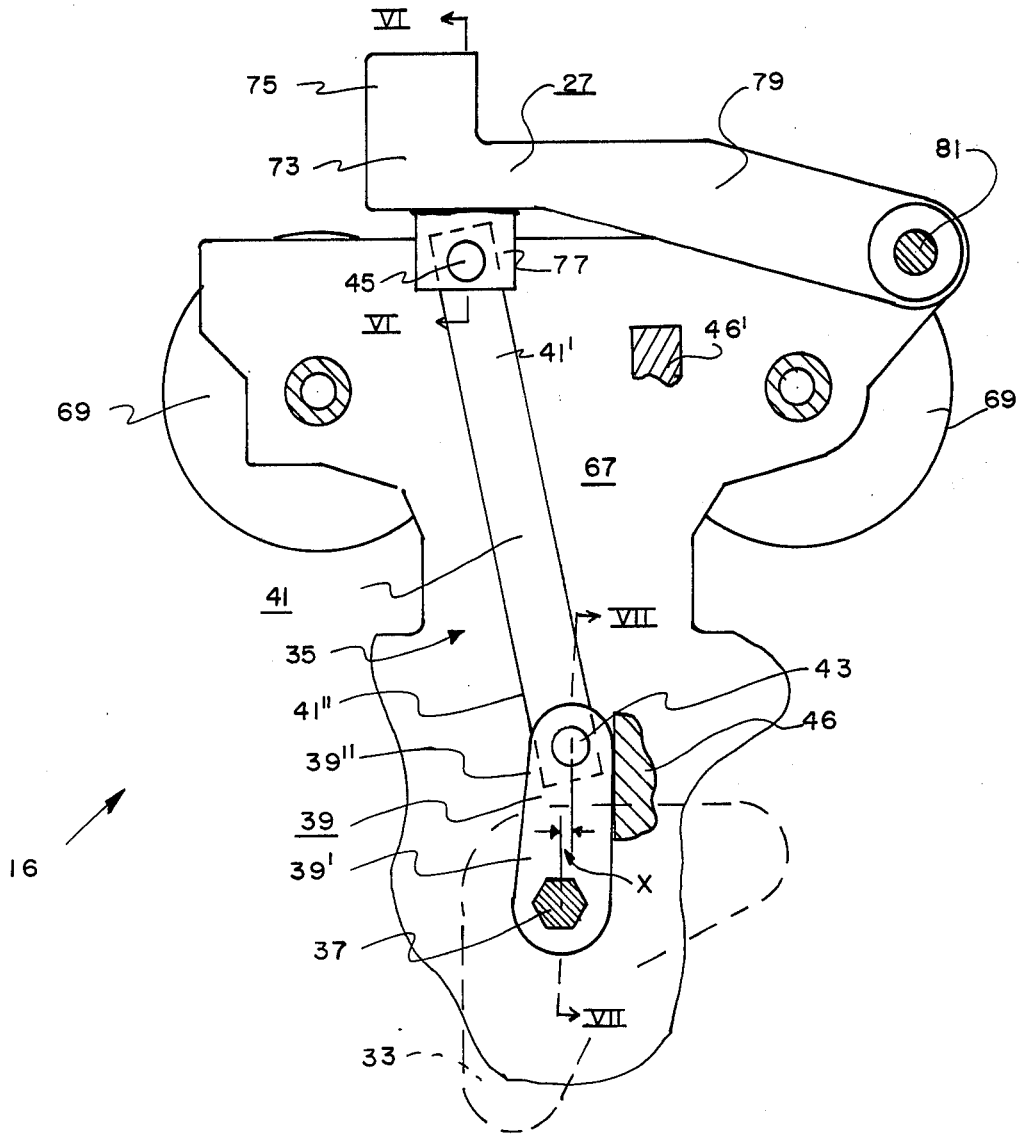
FIG. 5 is a somewhat schematic sectional view as taken on line V—V of FIG. 4 and with certain portions shown in broken lines for clarity.
Figure 6:
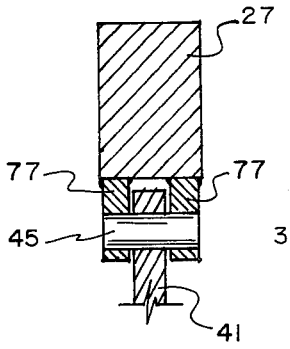
FIG. 6 is a sectional view as taken on line VI—VI of FIG. 5.
Figure 7:
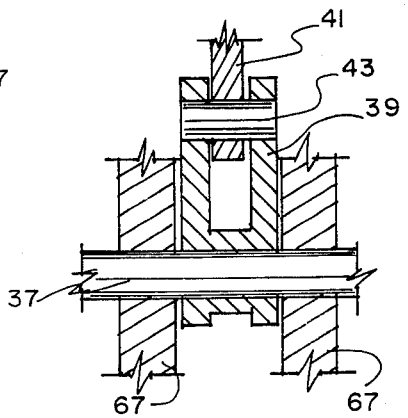
FIG. 7 is a sectional view as taken on line VII—VII of FIG. 5.

The dog means 27 preferably includes a first end 73 having a protrusion 75 thereon for being selectively engaged by a pusher means 25 and having boss portions 77 thereon for coacting with the pivot member 45 to pivotally attach the first end 41' of the second link member 41 to the dog means 27, and preferably includes a second end 79 for being pivotally attached to the body member 67 by way of a pivot member 81 or the like (see, in general, FIG. 5). The linkage means 35 is preferably located within the hollow interior of the body member 67. The pivot means 37 preferably extends through the hollow body member 67 to attach the first end 39' of the link member 39 located within the hollow interior of the body member 67 to the cam follower means 33 located outside the body member 67.

The operation of the control means of the present invention should now be apparent to those skilled in the art. In brief, a first drive means 29 is fixedly attached to the load supporting track 13 at any location where it is desired to move the dog means 27 to the first position where it will be engaged by a pusher means 25 to thereby push the trolley means along the load supporting track means 13. Likewise, a second drive means 31 is fixedly attached to the load supporting track 13 at any location where it is desired to move the dog means 27 to the second position out of engagement with the pusher means 25. The dog means 27 will remain in either of the first or second positions until moved to the other of the first or second positions by the first or second drive means 29, 31.

Although the present invention has been described and illustrated with respect to a preferred embodiment thereof, it is not to be so limited since changes and modifications may be made therein which are within the full intended scope of the invention.

I claim:

1. The combination with a power-and-free conveyor system which includes a load supporting track means, a trolley means for supporting an article to be conveyed, said trolley means being movably mounted to said load supporting track means, and a pusher means for selectively pushing said trolley means from one location to another, of control means for causing said trolley means to be placed into and out of driving engagement with said pusher means, said control means including:

(a) dog means for being attached to said trolley means and for movement between a first position in engagement with said pusher means and a second position out of engagement with said pusher means;

(b) first drive means for being fixedly attached relative to said load supporting track means and for moving said dog means from said second position to said first position;

(c) second drive means for being fixedly attached relative to said load supporting track means and for moving said dog means from said first position to said second position, said dog means remaining in either of said first or second positions until positively moved to the other of said first or second positions by said first or second drive means;

(d) drivable means attached to said trolley means for being moved between first and second positions by said first and second drive means;

(e) pivot means for pivotally attaching said drivable means to said trolley means; and (f) linkage means extending between said drivable means and said dog means for causing said dog means to move to said first position when said drivable means is moved to said first position and to move to said second position when said drivable means is moved to said second position, said linkage means including a first link member having a first end attached to said drivable means for pivotal movement therewith and having a second end, including a second link member having a first end pivotally attached to said dog means and having a second end, and including a pivot member for pivotally attaching said second ends of said first and second link members one to another, the axis of said pivot member attaching said second ends of said first and second link members to one another being horizontally offset from the axis of said pivot means attaching said drivable means to said trolley means when said dog means is in either of said first or second positions and being located on one side of the axis of said pivot means attaching said drivable means to said trolley means when said dog means is in said first position and being located on the other side of the axis of said pivot means attaching said drivable means to said trolley means when said dog means is in said second position.

2. The combination of claim 1 in which said first drive means engages said drivable means at a point above the axis of said pivot means attaching said drivable means to said trolley means, and in which said second drive means engages said drivable means at a point below the axis of said pivot means attaching said drivable means to said trolley means.

3. The combination of claim 1 in which the axis of said pivot member attaching said second ends of said first and second link members to one another is forward of the axis of said pivot means attaching said drivable means to said trolley means when said dog means is in said first position and is rearward thereof when said dog means is in said second position.

4. Control means for a conveyor system which includes a trolley member selectively driven by a pusher member to move a load from one location to another, said control means comprising: a dog means attached to said trolley member for movement between a first position in engagement with said pusher member and a second position out of engagement with said pusher member; a first drive means for moving said dog means from said second position to said first position; a second drive means for moving said dog means from said first position to said second position, said dog means staying in either of said first or second positions until moved to the other of said first or second positions by said first or second drive means; drivable means attached to said trolley member for being moved between first and second positions by said first and second drive means; pivot means for pivotally attaching said drivable means to said trolley member; and linkage means for causing said dog means to move to said first position when said drivable means is moved to said first position and to move to said second position when said drivable means is moved to said second position; said linkage means including a first link member having a first end attached to said drivable means for pivotal movement therewith and having a second end, including a second link member having a first end pivotally attached to said dog means and having a second end, and including a pivot member for pivotally attaching said second ends of said first and second link members to one another, the axis of said pivot member being located on one side of the axis of said pivot means when said dog means is in said first position and being located on the other side of the axis of said pivot means when said dog means is in said second position.

5. The control means of claim 4 in which said first drive means engages said drivable means at a point above the axis of said pivot means attaching said drivable means to said trolley means, and in which said second drive means engages said drivable means at a point below the axis of said pivot means attaching said drivable means to said trolley means.

* * * * *